US011460263B1

(12) United States Patent
McKinney

(10) Patent No.: US 11,460,263 B1
(45) Date of Patent: Oct. 4, 2022

(54) ARROW REST ASSEMBLY

(71) Applicant: Seth McKinney, Newport, OR (US)

(72) Inventor: Seth McKinney, Newport, OR (US)

( * ) Notice: Subject to any disclaimer, the term of this patent is extended or adjusted under 35 U.S.C. 154(b) by 0 days.

(21) Appl. No.: 17/404,245

(22) Filed: Aug. 17, 2021

(51) Int. Cl.
*F41B 5/22* (2006.01)
*F41B 5/14* (2006.01)
*F41B 5/10* (2006.01)

(52) U.S. Cl.
CPC ..... *F41B 5/143* (2013.01); *F41B 5/10* (2013.01)

(58) Field of Classification Search
CPC ..... F41B 5/143
See application file for complete search history.

(56) References Cited

U.S. PATENT DOCUMENTS 4,664,093 A * 5/1987 Nunemaker ..... F41B 5/143 124/44.5
4,838,237 A * 6/1989 Cliburn ..... F41B 5/143 124/44.5
4,967,722 A 11/1990 Roberts
5,042,450 A * 8/1991 Jacobson ..... F41B 5/143 124/44.5
5,085,201 A 2/1992 Tepper
5,144,937 A 9/1992 Colvin
5,213,090 A 5/1993 Tone
D346,845 S 5/1994 Sears
5,460,151 A 10/1995 Hamilton, Jr.
6,877,500 B1 4/2005 Hollars
9,261,322 B1 * 2/2016 Conkel ..... F41B 5/126

FOREIGN PATENT DOCUMENTS

WO WO2012047415 4/2012

* cited by examiner

*Primary Examiner* — John A Ricci

(57) ABSTRACT

An arrow rest assembly includes a compound bow has a riser. A mounting member is provided and the mounting member is mounted to a riser of a compound bow. A screw is provided and the screw is attachable to the mounting member. An arrow rest is attachable to the screw such that the arrow rest is positioned on an opposite side of the riser of the compound bow with respect to the mounting member. The arrow rest is aligned with an arrow that is shot with the compound bow. The arrow rest has an arrow slot that is integrated into the arrow rest to receive a shaft of the arrow. The arrow rest twists along a longitudinal axis of the arrow rest such that a bounding surface of the arrow slot twists in a clockwise orientation to impart a clockwise rotation into the arrow when the arrow is shot with the compound bow.

8 Claims, 6 Drawing Sheets

ARROW REST ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to arrow rest devices and more particularly pertains to a new arrow rest device for imparting rotation in an arrow that is shot with a compound bow. The device includes a mounting member that is attachable to a riser of a compound bow and an arrow rest that is attached to the mounting member. The arrow rest has an arrow slot integrated into the arrow rest for receiving a shaft of the arrow. The arrow slot twists along a longitudinal axis of the arrow rest to impart rotation into the arrow when the arrow is shot.

(2) Description of Related Art Including Information Disclosed Under 37 CFR 1.97 and 1.98

The prior art relates to arrow rest devices including a variety of arrow rest devices that are attachable to a riser of an archery bow. In each instance the arrow rest devices are structured such to facilitate a linear surface upon which the shaft of an arrow can rest when the arrow is being shot by the archery bow. The prior art discloses an arrow rest device for imparting rotation into an arrow. The arrow rest device includes a rod which has a twisting groove which extends partially around an outer surface rod which receives a shaft of the arrow and which imparts rotation into the arrow when the arrow travels along the rod.

BRIEF SUMMARY OF THE INVENTION

An embodiment of the disclosure meets the needs presented above by generally comprising a compound bow has a riser. A mounting member is provided and the mounting member is mounted to a riser of a compound bow. A screw is provided and the screw is attachable to the mounting member. An arrow rest is attachable to the screw such that the arrow rest is positioned on an opposite side of the riser of the compound bow with respect to the mounting member. The arrow rest is aligned with an arrow that is shot with the compound bow. The arrow rest has an arrow slot that is integrated into the arrow rest to receive a shaft of the arrow. The arrow rest twists along a longitudinal axis of the arrow rest such that a bounding surface of the arrow slot twists in a clockwise orientation to impart a clockwise rotation into the arrow when the arrow is shot with the compound bow.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
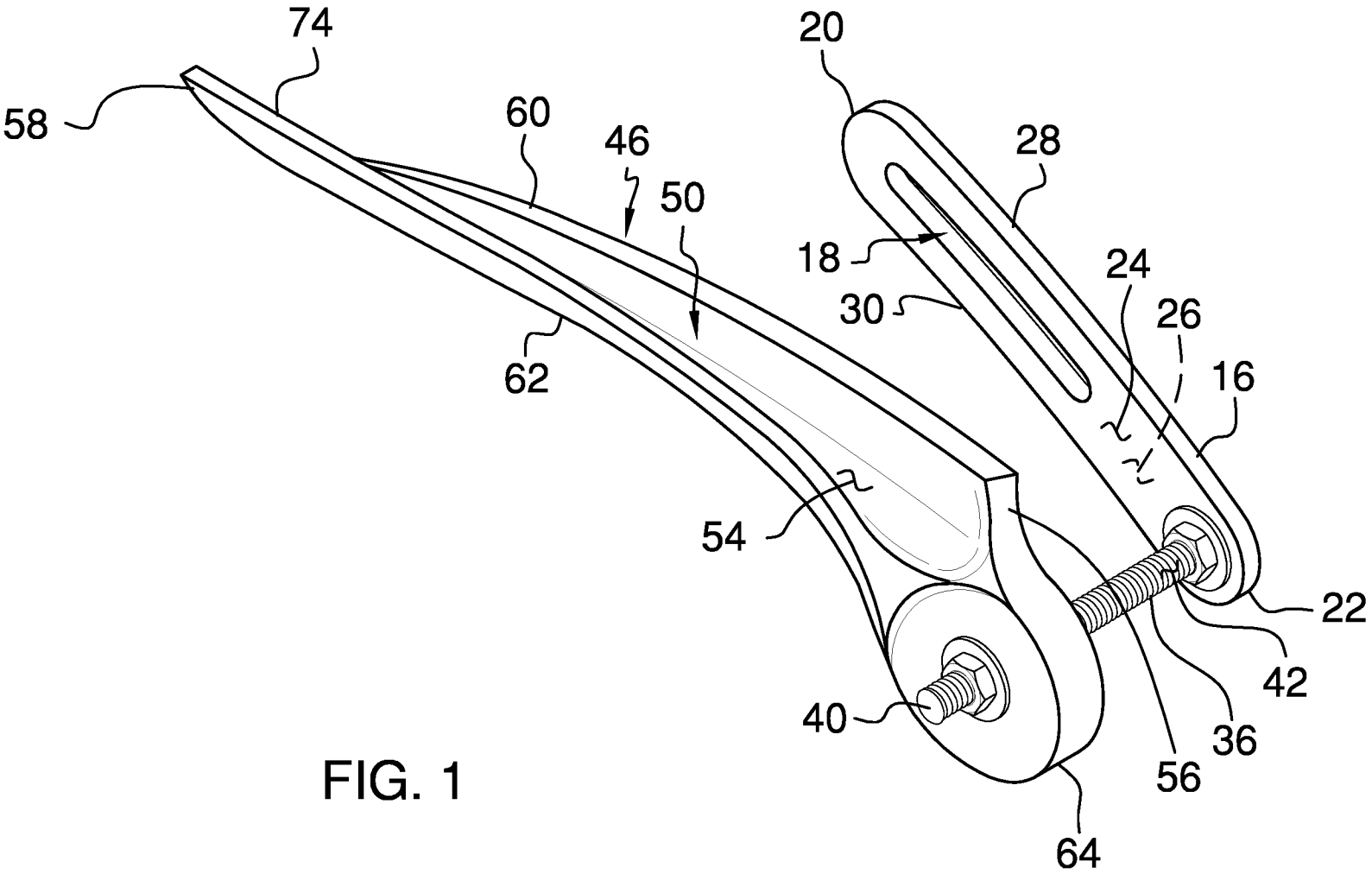
FIG. 1 is a perspective view of an arrow rest assembly according to an embodiment of the disclosure.
Figure 2:
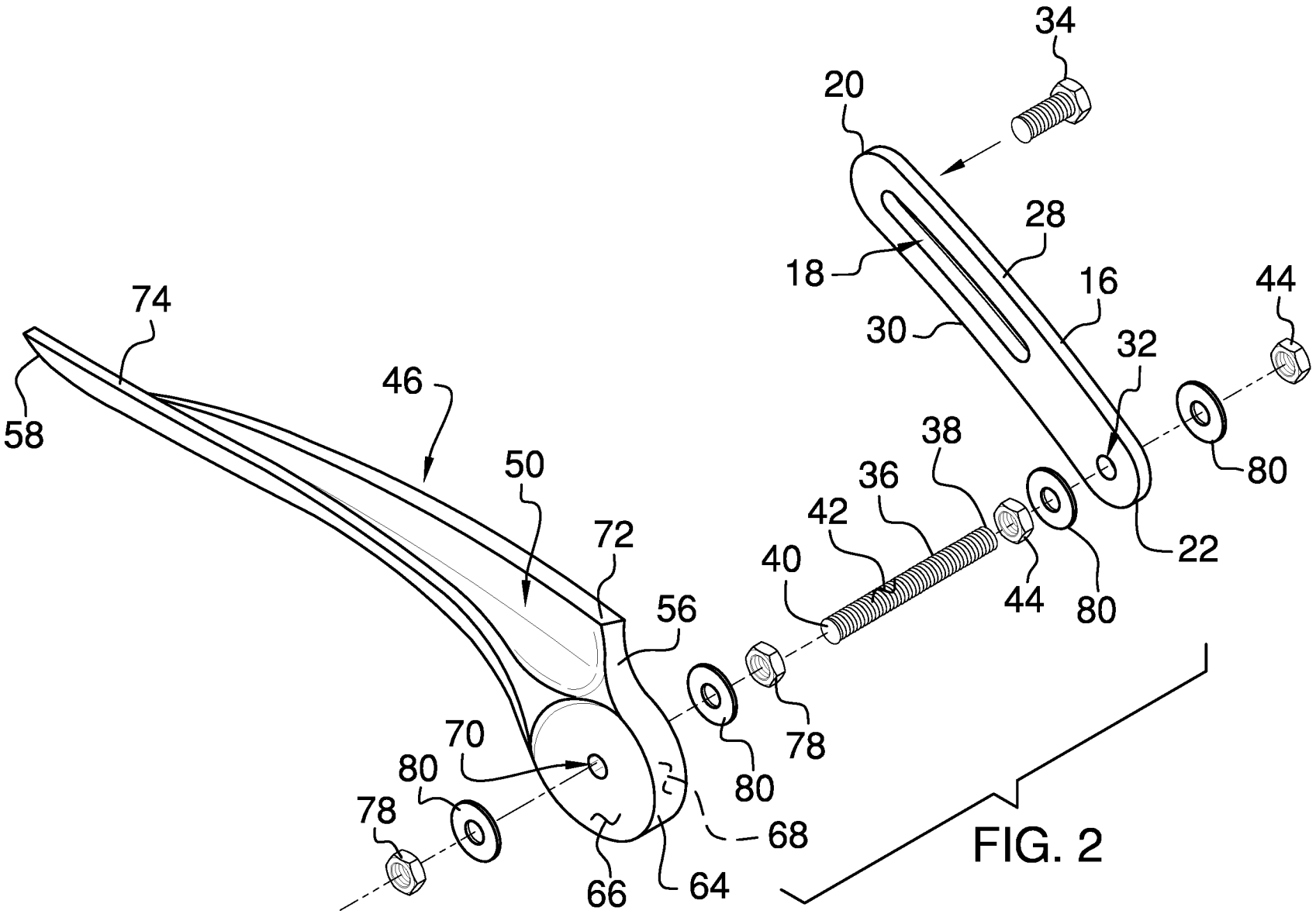
FIG. 2 is an exploded perspective view of an embodiment of the disclosure.
Figure 3:
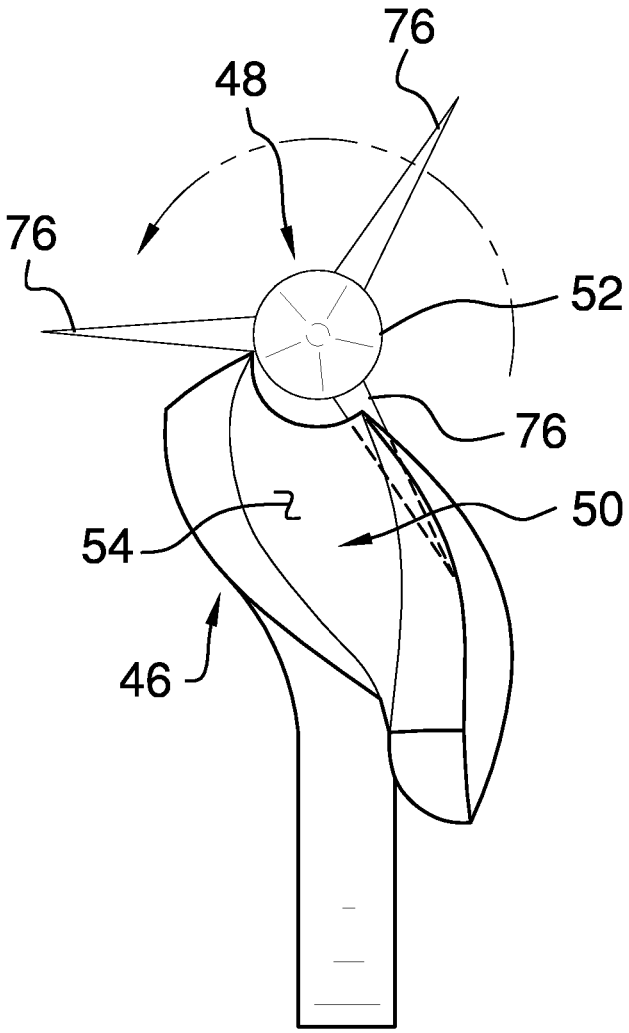
FIG. 3 is a front view of an embodiment of the disclosure.
Figure 4:
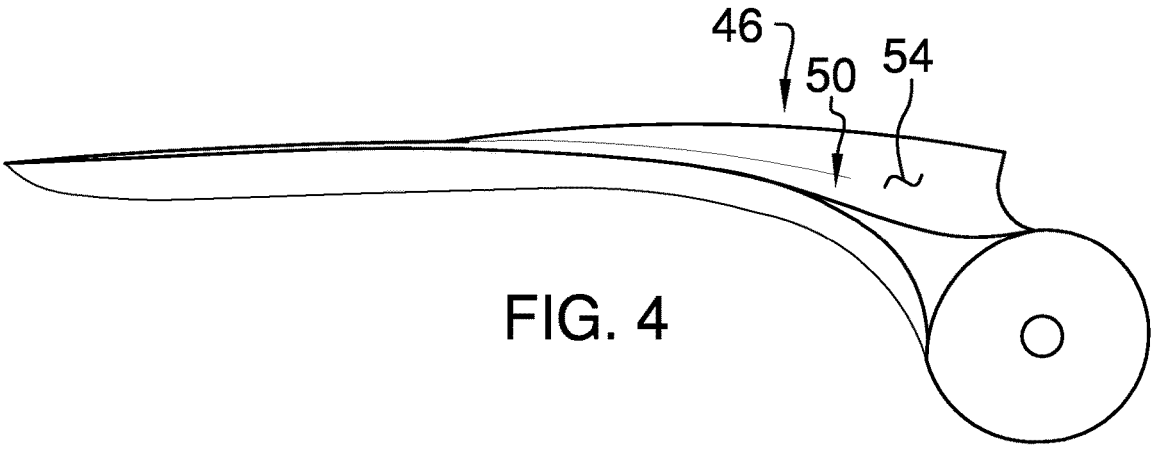
FIG. 4 is a left side view of an arrow rest of an embodiment of the disclosure.
Figure 5:
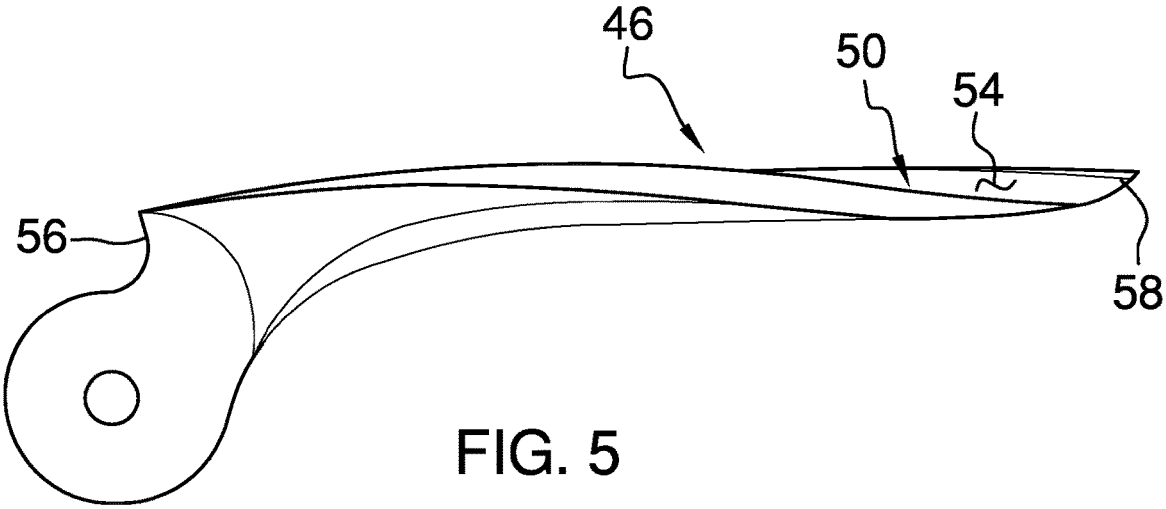
FIG. 5 is a right side view of an arrow rest of an embodiment of the disclosure.
Figure 6:
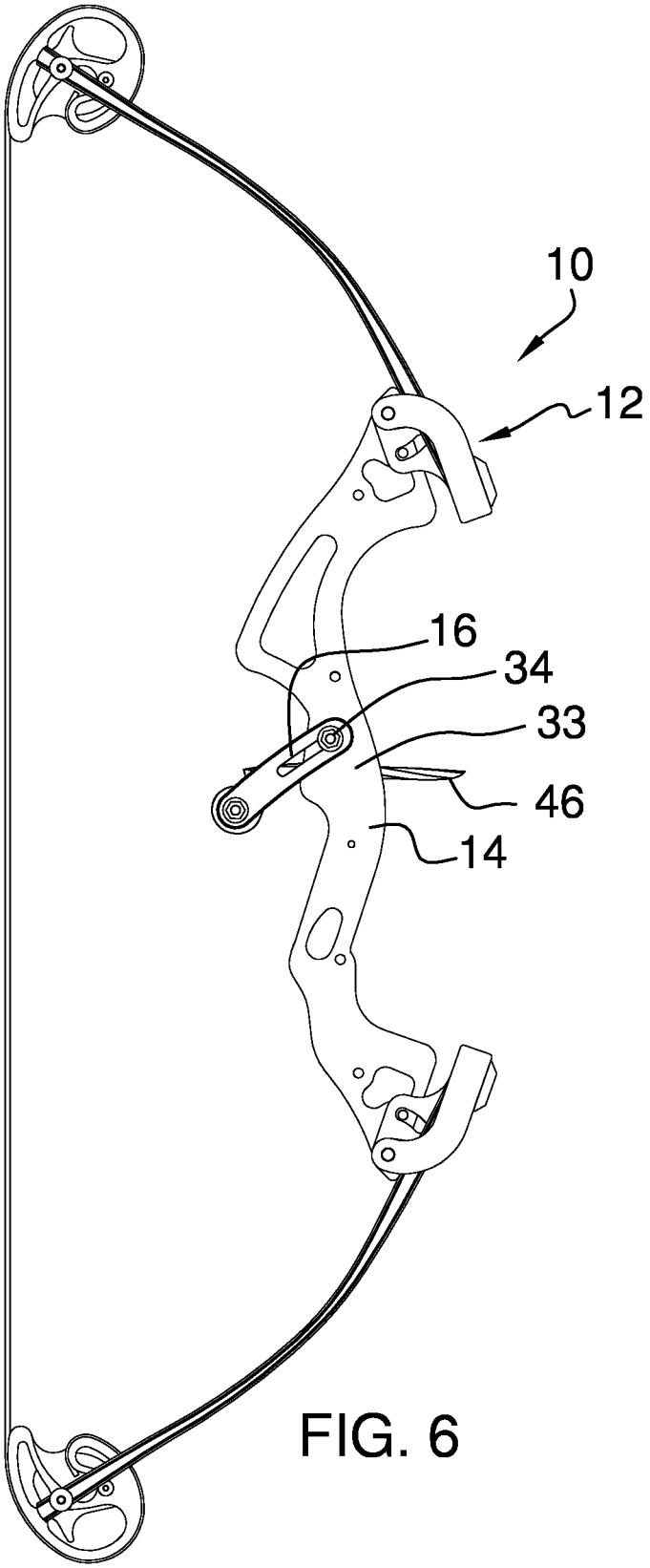
FIG. 6 is a right side in-use view of an embodiment of the disclosure.
Figure 7:
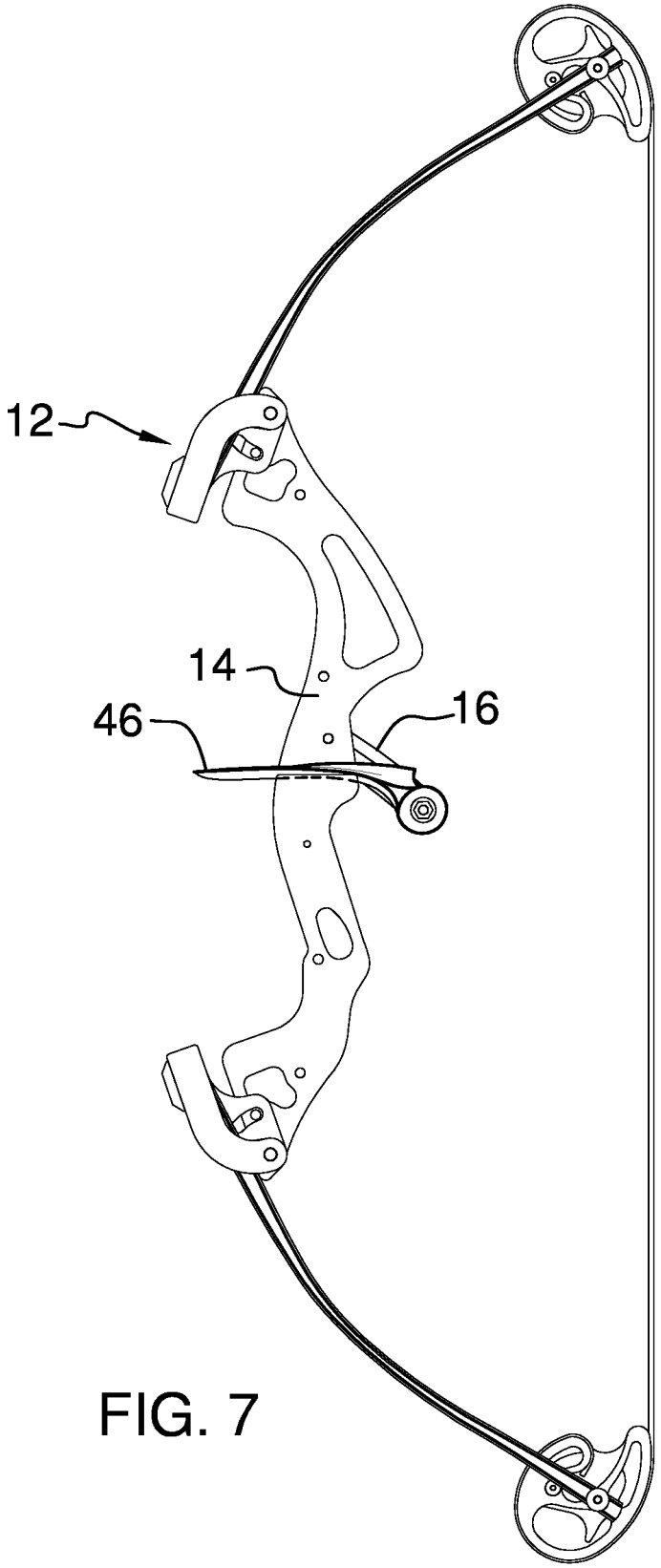
FIG. 7 is a left side in-use view of an embodiment of the disclosure.

With reference now to the drawings, and in particular to FIGS. 1 through 7 thereof, a new arrow rest device embodying the principles and concepts of an embodiment of the disclosure and generally designated by the reference numeral 10 will be described.

As best illustrated in FIGS. 1 through 7, the arrow rest assembly 10 generally comprises a compound bow 12 that has a riser 14. The compound bow 12 may be a compound bow of any conventional design that is commonly employed for hunting or competitive archery. A mounting member 16 is provided that has a mounting slot 18 extending through the mounting member 16. The mounting member 16 is positionable against the riser 14 of the compound bow 12.

The mounting member 16 has a first end 20, a second end 22, a first lateral surface 24, a second lateral surface 26, a top edge 28 and a bottom edge 30. The mounting member 16 is elongated between the first end 20 and the second end 22, and each of the first end 20 and the second end 22 is rounded. Each of the top edge 28 and the bottom edge 30 is curved between the first end 20 and the second end 22. Additionally, the mounting slot 18 extends through the first lateral surface 24 and the second lateral surface 26. The mounting slot 18 is elongated to extend along an axis extending between the first end 20 and the second end 22, and the mounting slot 18 is positioned closer to the first end 20 than the second end 22. The mounting member 16 has a bolt hole 32 extending through the first lateral surface 24 and the second lateral surface 26, and the bolt hole 32 is positioned adjacent to the second end 22. The first lateral surface 24 of the mounting member 16 rests against a first lateral side 33 of the riser 14 of the compound bow 12 such that the mounting member 16 extends rearwardly from the riser 14.

A bolt 34 is extendable through the mounting slot 18 and engages the riser 14 of the compound bow 12 for securing the mounting member 16 to the riser 14. The bolt 34 is positionable at a variety of locations along the mounting slot 18 such the mounting member 16 can be adjusted to accommodate a user's preferences. A screw 36 is provided and the screw 36 is attachable to the mounting member 16. The screw 36 has a primary end 38, a secondary end 40 and an outer surface 42 extending between the primary end 38 and the secondary end 40. The outer surface 42 is threaded and the primary end 38 of the screw 36 is extended through the bolt hole 32 in the mounting member 16. A set of first nuts 44 is provided and each of the first nuts 44 is threadable onto the screw 36. Each of the first nuts 44 abuts a respective one of the first lateral surface 24 and the second lateral surface 26 of the mounting member 16 for securing the screw 36 to the mounting member 16.

An arrow rest 46 is attachable to the screw 36 such that the arrow rest 46 is positioned on an opposite side of the riser 14 of the compound bow 12 with respect to the mounting member 16. In this way the arrow rest 46 can be aligned with an arrow 48 being shot with the compound bow 12. The arrow rest 46 has an arrow slot 50 that is integrated into the arrow rest 46 and the arrow slot 50 receives a shaft 52 of the arrow 48. Furthermore, the arrow slot 50 extends along a full length of the arrow rest 46. The arrow rest 46 twists along a longitudinal axis of the arrow rest 46 such that a bounding surface 54 of the arrow slot 50 twists in a clockwise orientation along the arrow rest 46. In this way the arrow slot 50 can impart a clockwise rotation into the arrow 48 when the arrow 48 is shot with the compound bow 12.

The arrow rest 46 has a rear end 56, a front end 58, an upper side 60 and a lower side 62. The arrow rest 46 is elongated between the rear end 56 and the front end 58 such that the longitudinal axis of the arrow rest 46 extends between the rear end 56 and the front end 58. The arrow rest 46 has a lobe 64 extending downwardly from the lower side 62 and the lobe 64 is aligned with the rear end 56. The lobe 64 has a first lateral surface 66 and a second lateral surface 68, and the lobe 64 has a bolt hole 70 extending through the first lateral surface 66 and the second lateral surface 68 of the lobe 64. The arrow slot 50 extends downwardly into the upper side 60 of the arrow rest 46 to define a first edge 72 and a second edge 74 each extending between the rear end 56 and the front end 58. Additionally, each of the first edge 72 and the second edge 74 extend along opposite sides of the arrow slot 50. As is most clearly shown in FIG. 4 and The bounding surface 54 of the arrow slot 50 is concavely arcuate between the first edge 72 and the second edge 74. Furthermore, the arrow rest 46 is twisted between the rear end 56 and the front end 58 such that the first edge 72 is spaced upwardly from the second edge 74 at the rear end 56 of the arrow rest 46 and the second edge 74 is spaced upwardly from the first edge 72 at the front end 58 of the arrow rest 46. In this way each of the first edge 72 and the second edge 74 engage feathers 76 on the arrow 48 such that the feathers 76 on the arrow 48 are urged to rotate in a clockwise direction when the arrow 48 travels along the bounding surface 54 of the arrow slot 50 when the arrow 48 is shot.

The secondary end 40 of the screw 36 is extendable through the bolt hole 32 in the lobe 64. A set of second nuts 78 is provided and each of the second nuts 78 is threadable onto the screw 36. Each of the second nuts 78 abuts a respective one of the first lateral surface 66 and the second lateral surface 68 of the lobe 64 to secure the arrow rest 46 on the screw 36. A plurality of washers 80 is provided and each of the washers 80 is positionable between a respective one of the second nuts 78 and the first nuts 44 and a respective one of the arrow rest 46 and the mounting member 16.

In use, the mounting member 16 is attached to the riser 14 of the compound bow 12 and the mounting member 16 is oriented at an angle on the riser 14 that corresponds to the geometry of the user's draw length and the physical characteristics of the user. The screw 36 is attached to the mounting member 16 and the arrow rest 46 is attached to the screw 36. Additionally, the arrow rest 46 is positioned at a strategic location on the screw 36 to position the arrow rest 46 at the optimum location to align with arrow rest 46 with the location of the arrow 48 when the arrow 48 is loaded onto the compound bow 12. Each of the first nuts 44 and the second nuts 78 is tightened on the screw 36 to retain the arrow rest 46 at the optimum location. In this way the feathers 76 on the arrow 48 travel along the first edge 72 and the second edge 74 of the arrow rest 46 when the arrow 48 is shot from the bow 12. Furthermore, the twisted shape of the arrow rest 46 imparts a clockwise rotation into the arrow 48 as the arrow 48 travels along the arrow rest 46. In this way accuracy of the arrow 48 is enhanced during flight thereby increasing the accuracy of the arrow 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An arrow rest assembly for imparting clockwise rotation into an arrow that is show from a bow, said assembly comprising:

a compound bow having a riser;

a mounting member having a mounting slot extending through said mounting member, said mounting member being positionable against said riser of said compound bow;

a bolt being extendable through said mounting slot and engaging said riser of said compound bow for securing said mounting member to said riser;

a screw being attachable to said mounting member; and an arrow rest being attachable to said screw such that said arrow rest is positioned on an opposite side of said riser of said compound bow with respect to said mounting member wherein said arrow rest is configured to be aligned with an arrow being shot with said compound bow, said arrow rest having an arrow slot being integrated into said arrow rest wherein said arrow slot is configured to receive a shaft of the arrow, said arrow slot extending along a full length of said arrow rest, said arrow rest twisting along a longitudinal axis of said arrow rest such that a bounding surface of said arrow slot twists in a clockwise orientation along said arrow rest wherein said arrow slot is configured to impart a clockwise rotation into the arrow when the arrow is shot with said compound bow.

2. The assembly according to claim 1, wherein:

said mounting member has a first end, a second end, a first lateral surface, a second lateral surface, a top edge and a bottom edge, said mounting member being elongated between said first end and said second end, each of said first end and said second end being rounded, each of said top edge and said bottom edge being curved between said first end and said second end;

said mounting slot extends through said first lateral surface and said second lateral surface, said mounting slot being elongated to extend along an axis extending between said first end and said second end, said mounting slot being positioned closer to said first end than said second end;

said mounting member has a bolt hole extending through said first lateral surface and said second lateral surface, said bolt hole being positioned adjacent to said second end; and said first lateral surface of said mounting member rests against a first lateral side of said riser of said compound bow such that said mounting member extends rearwardly from said riser.

3. The assembly according to claim 2, wherein said bolt is positionable at a variety of locations along said mounting slot wherein said mounting member is configured to be adjusted to accommodate a user's preferences.

4. The assembly according to claim 2, wherein:

said screw has a primary end, a secondary end and an outer surface extending between said primary end and said secondary end, said outer surface being threaded, said primary end of said screw being extended through said bolt hole in said mounting member; and said assembly includes a set of first nuts, each of said first nuts being threadable onto said screw, each of said first nets abutting a respective one of said first lateral surface and said second lateral surface of said mounting member for securing said screw to said mounting member.

5. The assembly according to claim 1, wherein:

said arrow rest has a rear end, a front end, an upper side and a lower side, said arrow rest being elongated between said rear end and said front end such that said longitudinal axis of said arrow rest extends between said rear end and said front end;

said arrow rest has a lobe extending downwardly from said lower side, said lobe being aligned with said rear end, said lobe having a first lateral surface and a second lateral surface, said lobe having a bolt hole extending through said first lateral surface and said second lateral surface of said lobe; and said arrow slot extends downwardly into said upper side of said arrow rest to define a first edge and a second edge each extending between said rear end and said front end.

6. The assembly according to claim 5, wherein said bounding surface of said arrow slot is concavely arcuate between said first edge and said second edge, said arrow rest being twisted between said rear end and said front end such that said first edge is spaced upwardly from said second edge at said rear end of said arrow rest and said second edge is spaced upwardly from said first edge at said front end of said arrow rest wherein each of said first edge and said second edge are each configured to engage feathers on the arrow such that the feathers on the arrow are urged to rotate in a clockwise direction when the arrow travels along said bounding surface of said arrow slot when the arrow is shot.

7. The assembly according to claim 6, wherein:

said screw has a primary end and a secondary end;

said secondary end of said screw is extendable through said bolt hole in said lobe; and said assembly includes a set of second nuts, each of said second nuts being threadable onto said screw, each of said second nuts abutting a respective one of said first lateral surface and said second lateral surface of said lobe to secure said arrow rest on said screw.

8. An arrow rest assembly for imparting clockwise rotation into an arrow that is show from a bow, said assembly comprising:

a compound bow having a riser;

a mounting member having a mounting slot extending through said mounting member, said mounting member being positionable against said riser of said compound bow, said mounting member having a first end, a second end, a first lateral surface, a second lateral surface, a top edge and a bottom edge, said mounting member being elongated between said first end and said second end, each of said first end and said second end being rounded, each of said top edge and said bottom edge being curved between said first end and said second end, said mounting slot extending through said first lateral surface and said second lateral surface, said mounting slot being elongated to extend along an axis extending between said first end and said second end, said mounting slot being positioned closer to said first end than said second end, said mounting member having a bolt hole extending through said first lateral surface and said second lateral surface, said bolt hole being positioned adjacent to said second end, said first lateral surface of said mounting member resting against a first lateral side of said riser of said compound bow such that said mounting member extends rearwardly from said riser;

a bolt being extendable through said mounting slot and engaging said riser of said compound bow for securing said mounting member to said riser, said bolt being positionable at a variety of locations along said mounting slot wherein said mounting member is configured to be adjusted to accommodate a user's preferences;

a screw being attachable to said mounting member, said screw having a primary end, a secondary end and an outer surface extending between said primary end and said secondary end, said outer surface being threaded, said primary end of said screw being extended through said bolt hole in said mounting member;

a set of first nuts, each of said first nuts being threadable onto said screw, each of said first nets abutting a respective one of said first lateral surface and said second lateral surface of said mounting member for securing said screw to said mounting member;

an arrow rest being attachable to said screw such that said arrow rest is positioned on an opposite side of said riser of said compound bow with respect to said mounting member wherein said arrow rest is configured to be aligned with an arrow being shot with said compound bow, said arrow rest having an arrow slot being integrated into said arrow rest wherein said arrow slot is configured to receive a shaft of the arrow, said arrow slot extending along a full length of said arrow rest, said arrow rest twisting along a longitudinal axis of said arrow rest such that a bounding surface of said arrow slot twists in a clockwise orientation along said arrow rest wherein said arrow slot is configured to impart a clockwise rotation into the arrow when the arrow is shot with said compound bow, said arrow rest having a rear end, a front end, an upper side and a lower side, said arrow rest being elongated between said rear end and said front end such that said longitudinal axis of said arrow rest extends between said rear end and said front end, said arrow rest having a lobe extending downwardly from said lower side, said lobe being aligned with said rear end, said lobe having a first lateral surface and a second lateral surface, said lobe having a bolt hole extending through said first lateral surface and said second lateral surface of said lobe, said arrow slot extending downwardly into said upper side of said arrow rest to define a first edge and a second edge each extending between said rear end and said front end, said bounding surface of said arrow slot being concavely arcuate between said first edge and said second edge, said arrow rest being twisted between said rear end and said front end such that said first edge is spaced upwardly from said second edge at said rear end of said arrow rest and said second edge is spaced upwardly from said first edge at said front end of said arrow rest wherein each of said first edge and said second edge are each configured to engage feathers on the arrow such that the feathers on the arrow are urged to rotate in a clockwise direction when the arrow travels along said bounding surface of said arrow slot when the arrow is shot, said secondary end of said screw being extendable through said bolt hole in said lobe; and a set of second nuts, each of said second nuts being threadable onto said screw, each of said second nuts abutting a respective one of said first lateral surface and said second lateral surface of said lobe to secure said arrow rest on said screw.

* * * * *